US006911770B2

(12) United States Patent
Schueller et al.

(10) Patent No.: US 6,911,770 B2
(45) Date of Patent: Jun. 28, 2005

(54) APPARATUS WITH A CAP AND COVER ASSEMBLY, AN ELECTRON GUN WITH A CAP ASSEMBLY, AND A METHOD OF USING A TUBE

(75) Inventors: Randolph D. Schueller, Austin, TX (US); Duane T. Smith, Round Rock, TX (US)

(73) Assignee: Trepton Research Group, Inc., Santa Clara, CA (US)

( * ) Notice: Subject to any disclaimer, the term of this patent is extended or adjusted under 35 U.S.C. 154(b) by 0 days.

(21) Appl. No.: 09/683,683

(22) Filed: Feb. 1, 2002

(65) Prior Publication Data

US 2003/0146686 A1 Aug. 7, 2003

(51) Int. Cl.[7] ..... H01J 29/48

(52) U.S. Cl. ..... 313/414; 313/417; 313/455; 313/456; 313/459; 313/438; 313/482; 313/250; 445/33; 445/34; 250/427; 250/423 R

(58) Field of Search ..... 313/250, 257, 313/268, 451, 456, 476, 450, 479, 414, 446, 146, 457, 459, 438, 383, 482; 445/33, 34; 250/427, 423 R

(56) References Cited

U.S. PATENT DOCUMENTS 4,323,813 A * 4/1982 Vieland et al. ..... 313/250
4,451,242 A * 5/1984 Miyazawa et al. ..... 445/65
5,075,588 A * 12/1991 Hunter ..... 313/25

* cited by examiner

*Primary Examiner*—Nimeshkumar D. Patel
*Assistant Examiner*—Sikha Roy
(74) *Attorney, Agent, or Firm*—Martine Penilla & Gencarella, LLP

(57) ABSTRACT

A cap can comprise an aperture, and an attenuator may block the aperture during at least one point in time. In one embodiment, the attenuator can include a cover that may be displaced by a spring. In another embodiment, such as an electron gun, may comprise a support cap with an aperture, a displaceable cover that may cover the aperture, and a spring. A material attached to the spring and acting as a fuse may release the spring and expose the aperture after an electrical current blows the "fuse". In yet another embodiment, a method for using a tube may comprise evacuating the tube while a cover covers an aperture in the support cap of a electron gun that is at least partially in the tube and moving the cover to expose the aperture after the tube is sealed.

15 Claims, 12 Drawing Sheets

APPARATUS WITH A CAP AND COVER ASSEMBLY, AN ELECTRON GUN WITH A CAP ASSEMBLY, AND A METHOD OF USING A TUBE

BACKGROUND OF INVENTION

1. Field of the Invention

The present invention relates to the field of electron emission and more specifically to methods and apparatuses using electron sources.

2. Description of the Related Art

Apparatuses and methods for incorporating conventional thermionic electron emission sources into devices, such as cathode ray tubes (CRTs), X-radiation tubes, or microwave tubes, are well known. Electron emission sources with better performance than common thermionic sources, such as field emission electron sources, may be less compatible with the apparatuses and methods designed for the common thermionic sources and can have their performance impaired by these apparatus and methods.

A common process for producing a vacuum tube 10, shown in FIG. 1, such as a CRT, involves securing an electron source or sources 12 to a support cap 14 that is a part of the electron gun structure 16 located in an end of the tube 10. A common support cap 14, illustrated in FIG. 2, is generally a cup or can shaped structure with at least one aperture 20 to allow electrons generated by the electron source to pass. Referring again to FIG. 1, a vacuum is commonly achieved in the tube by pumping the gas out of the tube through an opening 18 at the terminal end of the neck and then sealing the opening. When the gas is pumped out of the tube, the gas as well as particles of phosphor, DAG coating, or other particles existing in the tube may flow over the electron source. These particles may interfere with the emission properties of field emission electron sources and can even result in catastrophic electrical shorts.

Accordingly, apparatus and methods for preventing gas or particles present in the conventional processes of common electron source applications are needed to enable the benefits of improved electron sources to be more fully realized.

SUMMARY OF INVENTION

In embodiments described below, an apparatus may overcome the problems above by providing a structure to cover an electron and thus enable the utilization of a non-thermionic electron or source in a tube manufactured by conventional processes designed for thermionic electron sources. In other embodiments, methods are disclosed for using a tube incorporating a cover structure. Tubes using the disclosed apparatuses and methods may exhibit improved performance compared to prior tubes.

In one set of embodiments, an apparatus can comprise a cap including an aperture and can be configured to allow an electron to pass along an electron path through the aperture. The apparatus may further comprise a cover assembly that includes a cover adjacent to the aperture. The cover can be configured to lie along the electron path during at least one point in time. The cover assembly may further comprise a means for displacing the cover.

In another embodiment, an electron gun may comprise a cap assembly and a focus electrode spaced apart and electrically insulated from the cap assembly. The cap assembly can comprise a cap aperture, a cover, and a spring. The cover may overlie the cap aperture during at least one point in time. The spring can comprise a first end attached to the cover and a second end attached to the cap. The focus electrode may comprise a focus aperture in alignment with the cap aperture.

In yet another embodiment, a method of using a tube can comprise placing at least a portion of an electron gun within a first end of the tube. The electron gun may comprise a cap including an aperture. The cap may further comprise an attenuator assembly including an attenuator adjacent to the aperture. The attenuator may lie along a path for a electron beam within the electron gun when the electron gun is activated. The method may further comprise flowing a gas at least near a portion of the electron gun while the attenuator blocks the aperture, and sealing the tube. In one embodiment, flowing the gas may evacuate the tube.

The foregoing general description and the following detailed description are exemplary and explanatory only and are not restrictive of the invention, as defined in the appended claims.

BRIEF DESCRIPTION OF DRAWINGS

The present invention is illustrated by way of example and not limitation in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help improve understanding of embodiments of the present invention.

DETAILED DESCRIPTION

Reference is now made in detail to the exemplary embodiments of the invention, examples of which are illustrated in the accompanying drawings. Wherever possible, the same reference numbers will be used throughout the drawings to refer to the same or like parts (elements).

Described generally below are apparatuses and methods for protecting electron sources that can be used during tube production processes. A cap assembly for an electron source may comprise an aperture and an attenuator that blocks the aperture and protects the underlying electron source during processing. An electron gun may comprise a support cap assembly with an aperture and an attenuator and a focus electrode. A method of using a tube may comprise displacing an attenuator near an aperture through a cap assembly in an electron gun after the tube is sealed.

Figure 1:
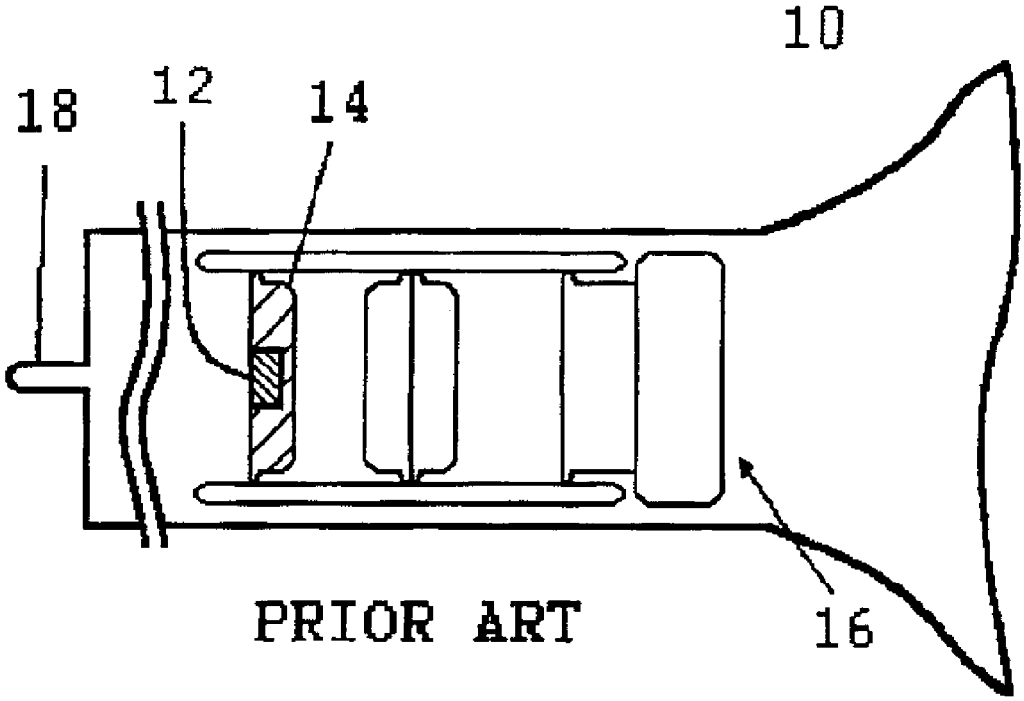
FIG. 1 includes an illustration of a cross-sectional view of a portion of a prior art tube with an electron gun and a tubulation.
Figure 2:
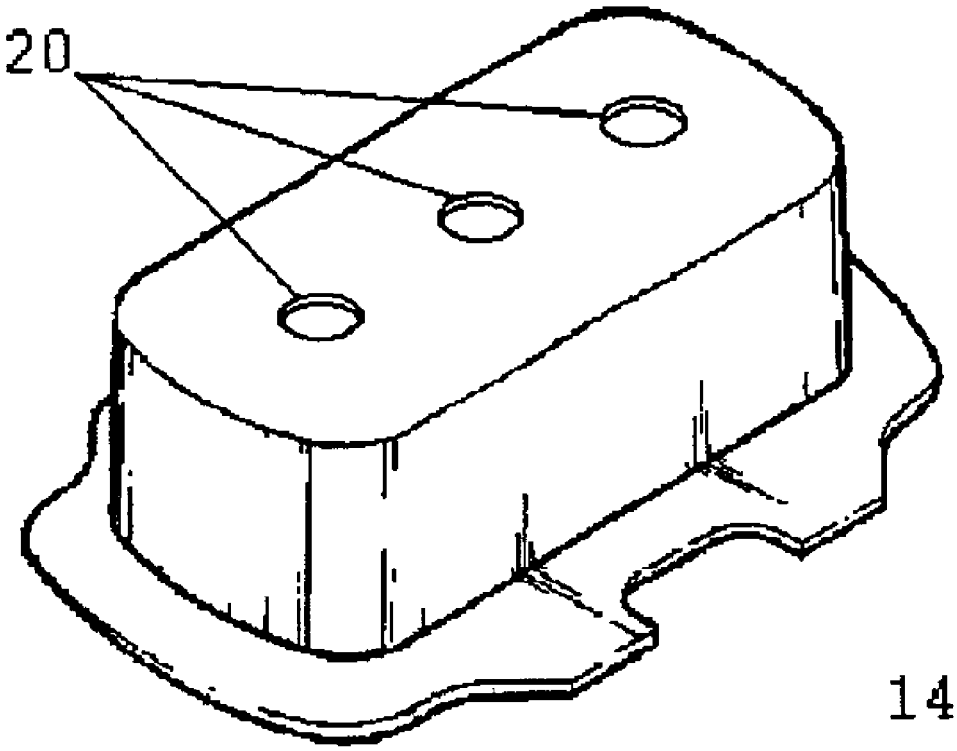
Prior Art FIG. 2
FIG. 2 includes an illustration of a prior art support cap with apertures.
Figure 3:
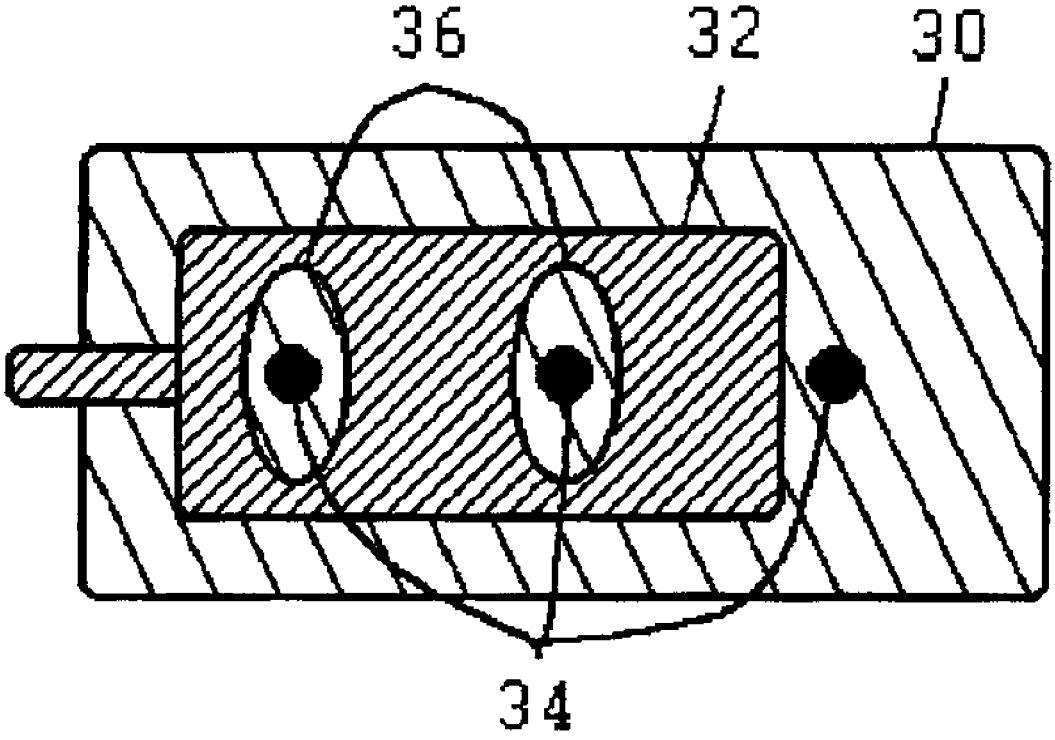
FIG. 3 includes an illustration of a top view of a support cap with apertures and a cover with openings in an open position exposing the apertures.

An embodiment illustrated in FIG. 3 may comprise a support cap assembly 30 with a cover 32 that may cover the apertures in 34 in the support cap 30 during at least one point in time, generally during tube assembly and evacuation. The support cap assembly 30 is similar to support cap 14 in FIG. 2 in that the assembly 30 also comprises three apertures 34 as would generally be found in an electron gun for a polychromatic tube. In other embodiments, nearly any number of apertures in the support cap assembly 30 may be used. As illustrated, the apertures 34 are exposed. Support cap 30 may comprise a generally can-shaped structure comprising stainless steel or another material of similar physical and reactive properties. The apertures 34 may have a span in the range of approximately 0.5–2 millimeters. Apertures 34 may be positioned such that electrons or other particles emitted from an electron source (e.g., x-rays or the like) (not shown) mounted to the support cap assembly 30 may pass through apertures 34.

In an embodiment, the cover 32 may be stamped, molded, cut, or formed via another common manufacture process and can comprise stainless steel, polyimide, an insulator, or another material able to withstand temperatures in the range of approximately 300–600 degrees Celsius as well as evolving minimal gases when placed in a low pressure environment. The cover 32 may have a length, width, and shape sufficient to cover at least one aperture 34 and may generally have a length and width in the range of approximately 3–20 millimeters and may have a thickness within the range of approximately 25–250 microns. The cover may further comprise openings 36 arranged to expose the apertures 34 when the cover is in an open position as illustrated in FIG. 3.

Figure 4:
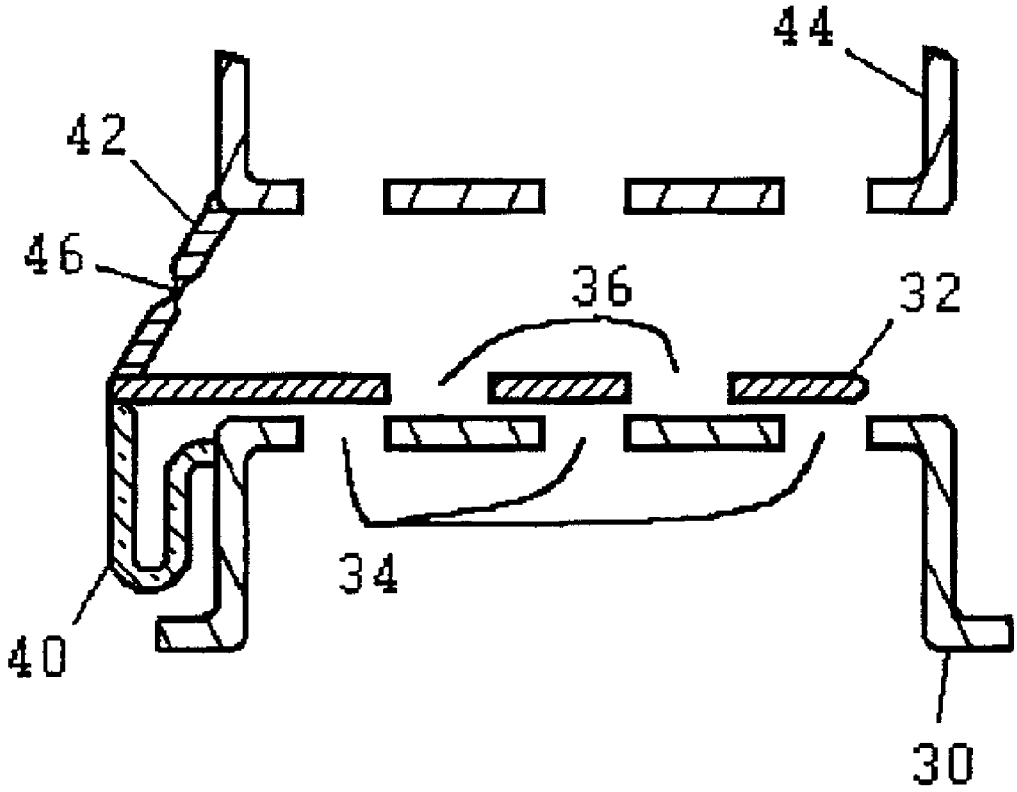
FIG. 4 includes an illustration of a cross sectional view of a portion of the side of a support cap with a cover and a spring in a closed position, a material holding the spring in a closed position, and a focus electrode.
Figure 5:
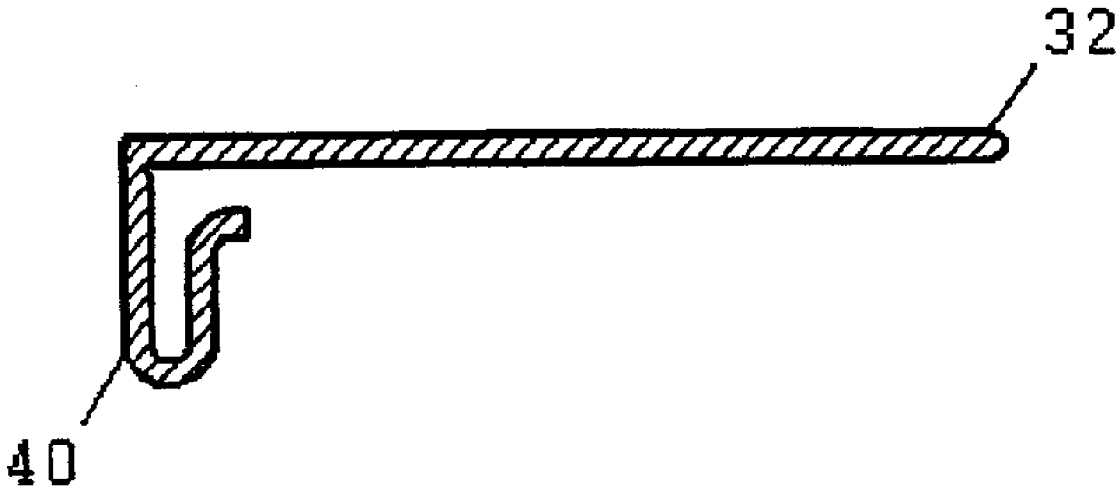
FIG. 5 includes an illustration of a cross-sectional view of a cover with an extension that may form a spring.

Another embodiment may comprise a means for displacing the cover 32. FIG. 4 illustrates a cover assembly comprising a spring 40 having one end attached to the cap assembly and the other end attached to the cover 32. Alternatively, the spring may 40 contact but not be attached to the cap assembly. The spring 40 may comprise the same material as the cover 32 and may be soldered, bonded, welded, or otherwise fastened at one end to the cover 32 and at the other end to the cap 30. In an embodiment the spring 40 may be formed as a part of the cover 32 (i.e., spring 40 and cover 32 from a single piece of material), as illustrated in FIG. 5. Referring to FIG. 4, the spring 40 may be positioned such that it is compressed, or is otherwise storing potential energy, when the cover 32 covers the apertures 34.

An embodiment may comprise a means for releasing the spring. Again referring to FIG. 4, the means for releasing the spring 40 may comprise a material 42 fastened at one end to the spring 40 and at another end to a substantially stationary object such as a focus electrode 44. The material 42 may comprise stainless steel or another conductor and may have a thickness in the range of approximately 30–90 microns and a width in the range of approximately 2–4 mm. Material 42 can comprise a substantially thin portion 46 that may have a width of approximately 1–2 mm.

Figure 6:
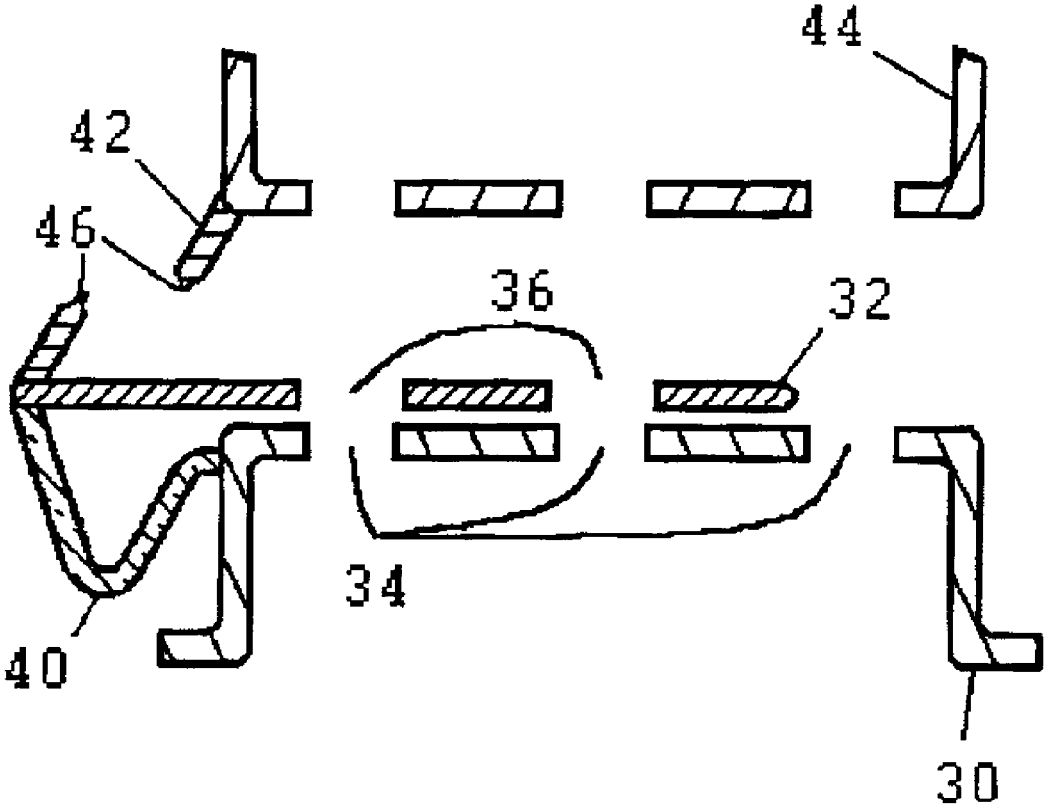
FIG. 6 includes an illustration of a cross-sectional view of the side of a support cap of FIG. 4 after the cover and spring are moved to an open position.

Illustrated in FIG. 6, an electrical circuit (not shown) can be activated to pass current through the material 42, which may act as a fuse. When a sufficient amount of electrical current passes through the material 42, the thin portion 46 may melt and release the spring 40. An electrical current of approximately 0.2–1 amp may melt the thin portion 46. Upon release, the spring 40 may displace the cover 32 such that the apertures 34 are exposed and may allow particles, such as electrons, photons, ions, or the like, to pass through the apertures 34 and openings 36. Openings 36 in the cover may surround the apertures 34. After reading the specification, skilled artisans realize that the material and cross-sectional area of the thin portion 46 can determine the current needed to blow the "fuse."

Figure 7:
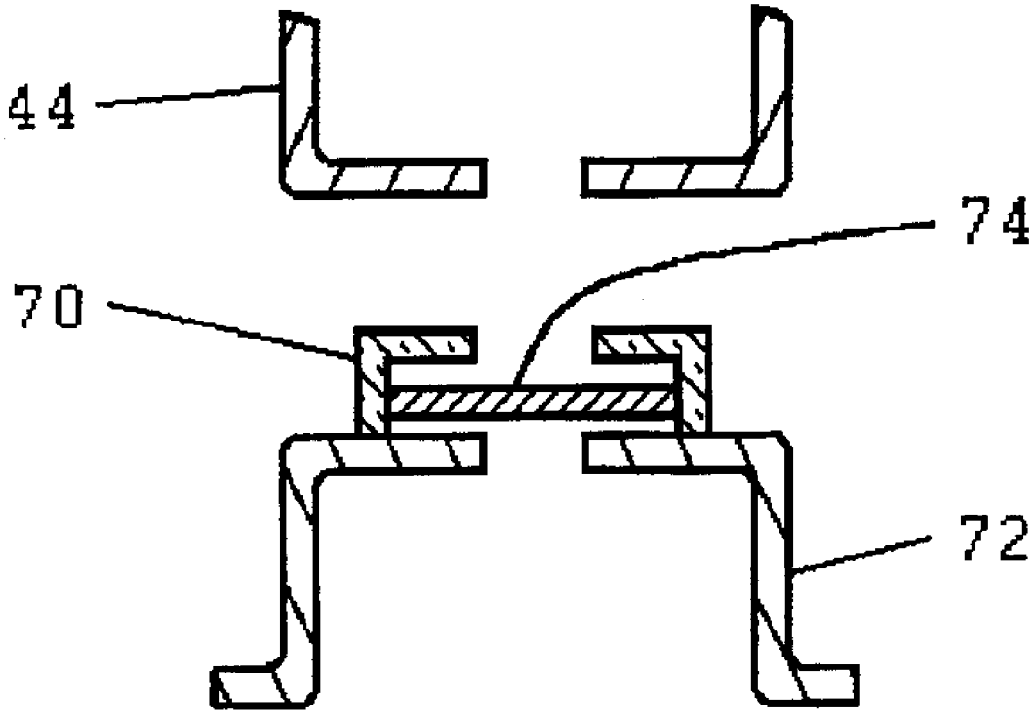
FIG. 7 and FIG. 8 each include an illustration of a cross-sectional view of the front of a support cap with a cover in a closed position and a cover guide and a focus electrode.

Yet another embodiment may comprise a cover guide 70, shown in FIG. 7. A material, such as stainless steel or any material capable of withstanding temperatures in the range of approximately 300–600 degrees Celsius without substantially deforming or evolving gas or other material may be used. The cover guide 70 may be soldered, bonded, welded, or otherwise attached to the cap 72. The cover 74 should be able to move along the path of the cover guide 70. The cover guide 70 may substantially prevent the cover 74 from contacting other parts such as focus electrode 44.

Figure 8:
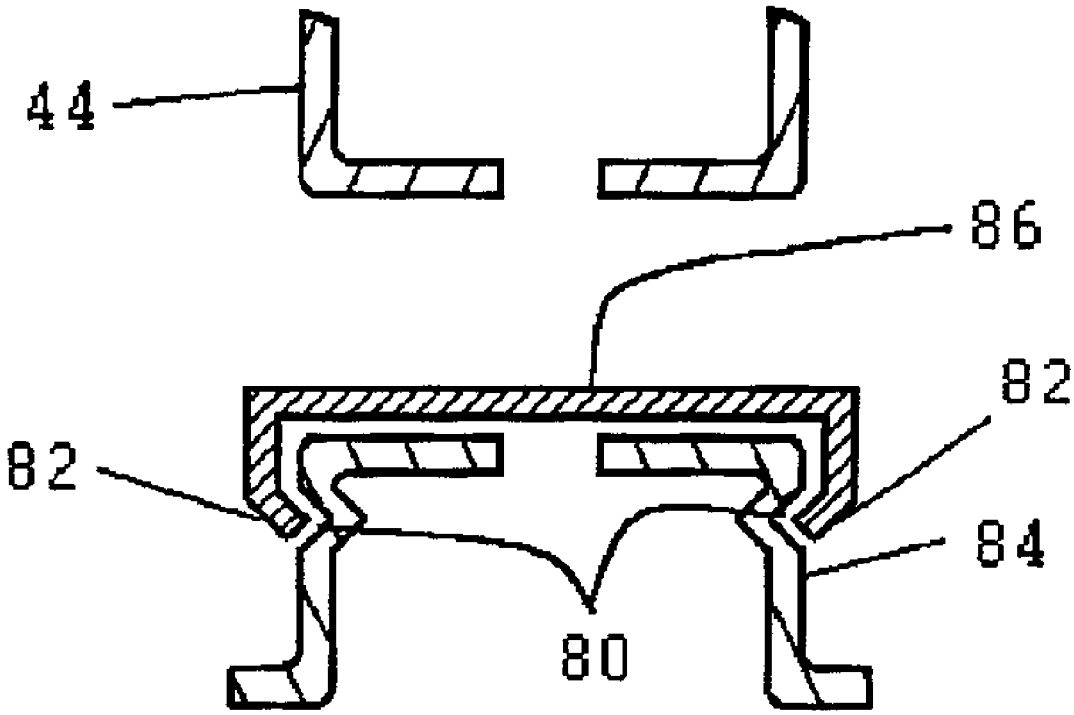

Alternatively, a cap may comprise indentions 80 formed in the side of the cap 84 through crimping, bending, or otherwise indenting the cap 84, as illustrated in FIG. 8. The cover 86 may be formed by bending, molding, or otherwise shaping the cover such that portions 82 of the cover 86 fit into cap indentations 80.

Figure 9:
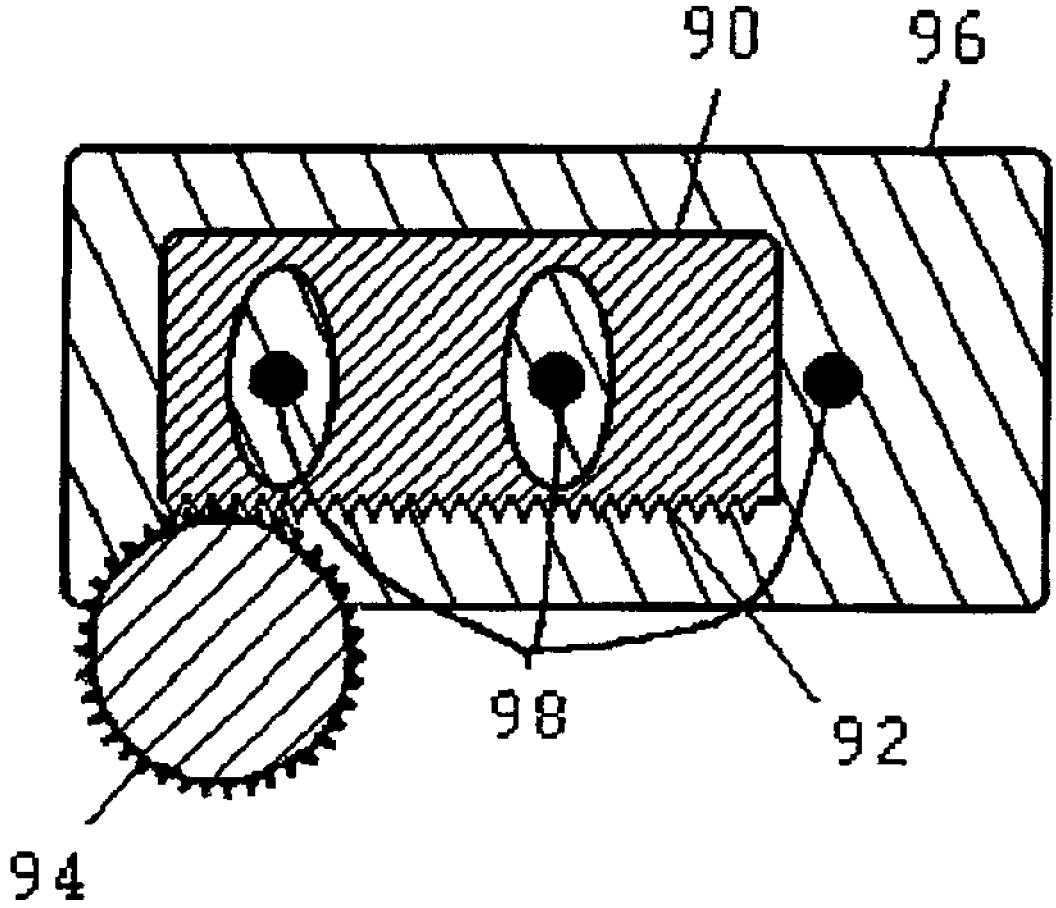
FIG. 9 includes an illustration of a top view of a support cap with a cover and a mechanical actuator for the cover.

In yet another embodiment, the cover assembly may further comprise an actuator. The cover 90 may be displaced by an actuator, such as a gear, piston, electromagnet, or other micro- or nano-machine structure. FIG. 9 shows a cover 90 formed with teeth 92 along one edge. A gear 94 may be driven by an electric motor (not shown) that may be mounted to the top or side of the cap 96 or to a different structure. An electronic circuit (not shown) can control of the electric motor and may allow the cover 90 to move to completely or partially expose apertures 98. The cover 90 may be moved more than one time.

Figure 10:
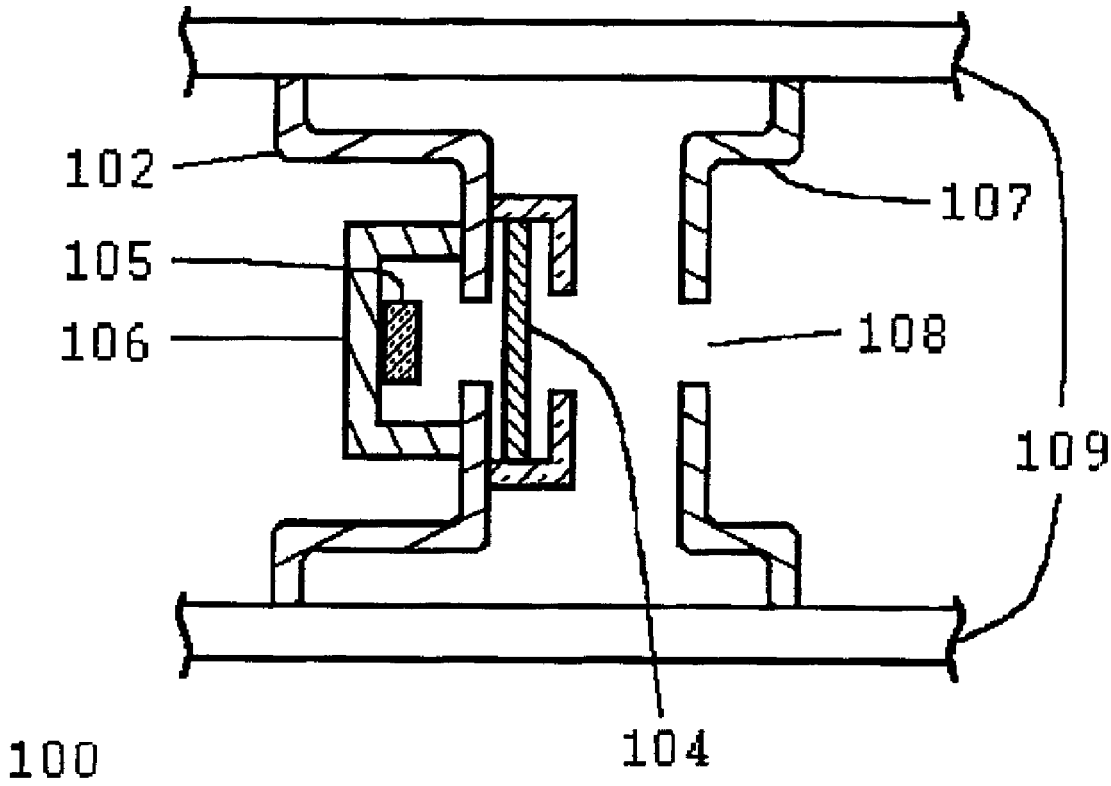
FIG. 10 includes an illustration of a cross-sectional view of a portion of an gun with an electron source and first focus electrode incorporating a support cap with a cover and a cover guide.

In an embodiment illustrated in FIG. 10, a substantially complete electron gun 100 may comprise a support cap assembly 102 and a cover 104, both similar to those described above. An electron source 105, such as a field emission cathode, may be mounted to the support cap 102 using conventional methods such as mounting the electron source 105 to a support 106 and welding, soldering, bonding, or otherwise mounting the support 106 to the cap 102.

The electron gun 100 may further comprise a focus electrode 107 spaced apart and electrically insulated from the cap assembly 102 and comprising a focus aperture 108. The first focus electrode 107 may be aligned with the support cap 102 such that electrons emanating from the electron source may pass through the support cap 102 and focus electrode 107. The aligned cap 102 and focus electrode 107 may be assembled using conventional beading processes that result in the insulating support structure 109. Additional focus electrodes may be used, wherein each focus electrode may have aperture(s) corresponding to aperture(s) in the support cap.

Figure 11:
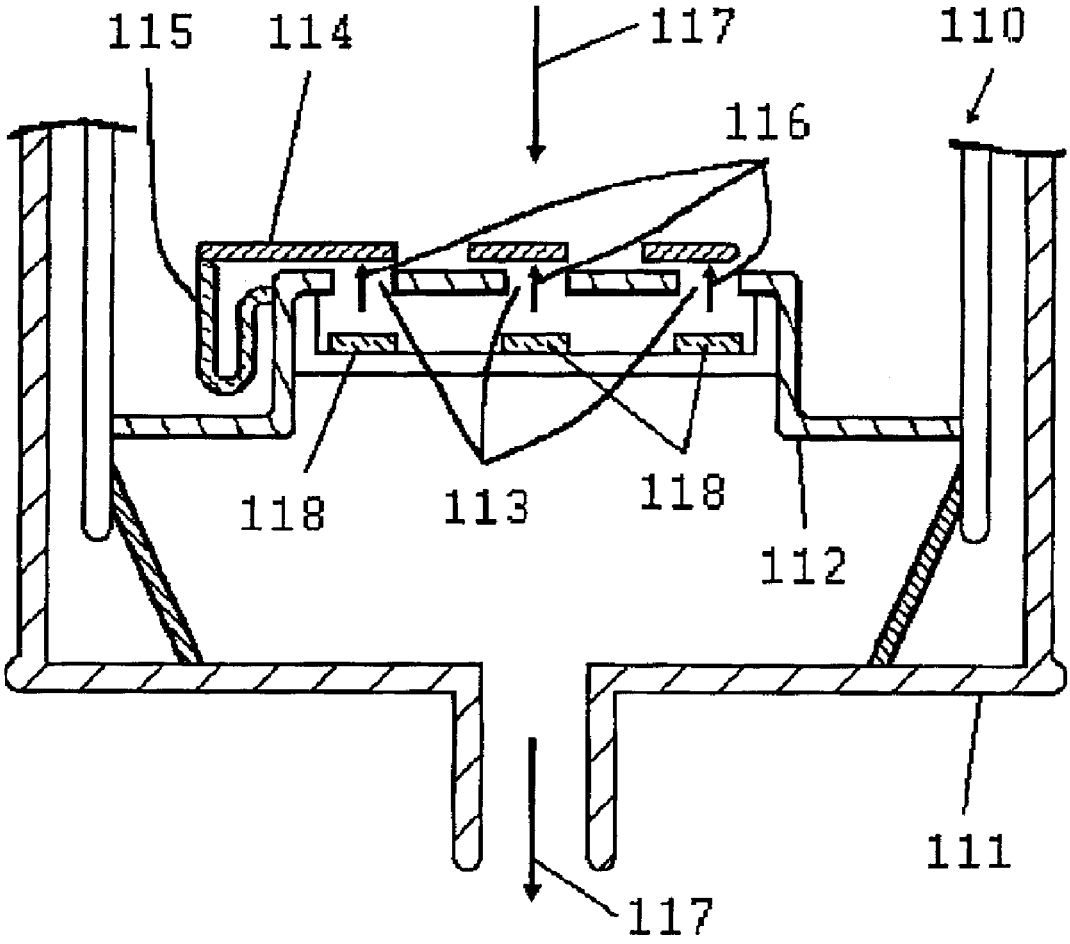
FIGS. 11 and 12 include illustrations of a cross-sectional view of a portion of a tube during a process of using the tube.
Figure 12:
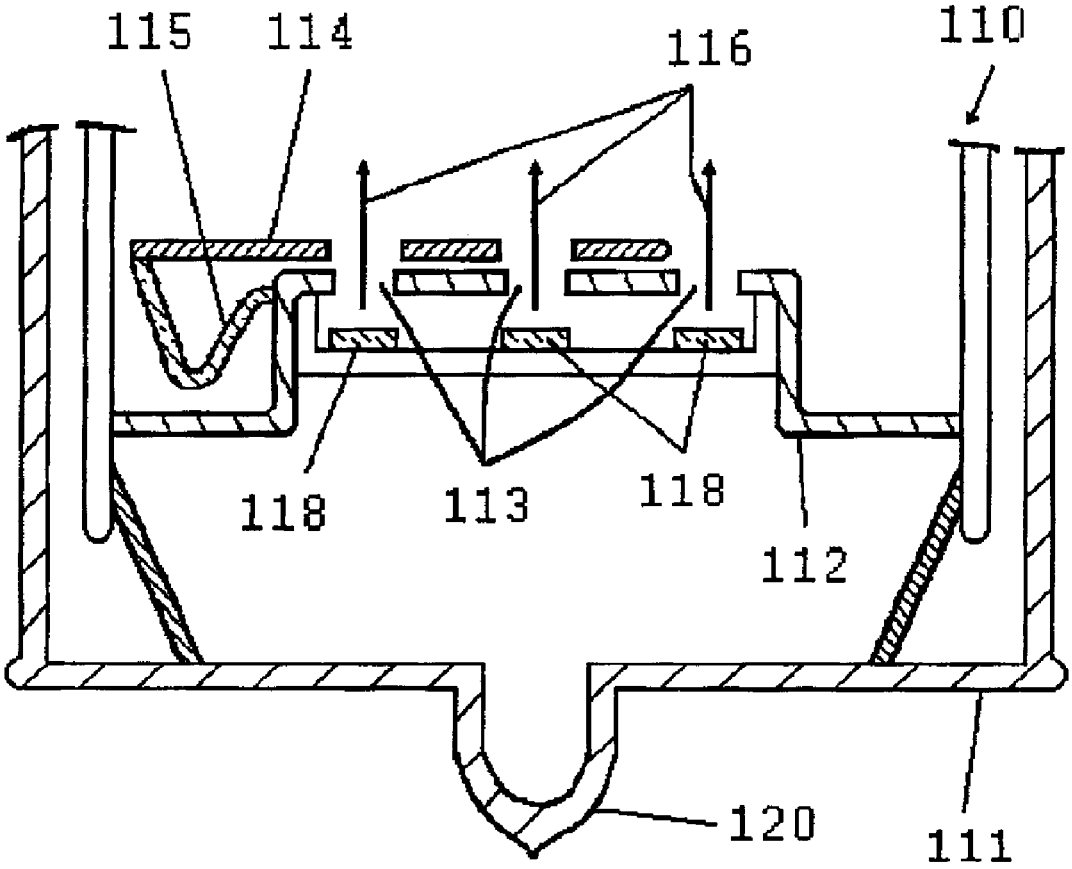

An exemplary method of using a tube is illustrated in FIGS. 11 and 12. The method can comprise placing at least a portion of an electron gun 110 within a first end of the tube 111. The electron gun may comprise a support cap 112 comprising, as described above, an aperture 113, a cover 114, and a means for displacing the cover, such as a spring 115. The cover may cover the aperture and thus lie along the path of the electron beam (not shown in FIG. 11) generated when the electron gun is activated.

The method may further comprise flowing a gas 117 at least near a portion of the electron gun 110 while the cover 114 covers the aperture 113. Flowing the gas 117 may comprise evacuating the tube 111. The tube 111 may generally be pumped down to a pressure of approximately 1E5 torr or lower. The gas may comprise air or common processing gases, such as methane or natural gas, as well as particles existing in the tube, such as DAG or phosphor coatings. The cover 114 may substantially prevent these gases 117 and particles from contaminating the electron source 118. After the tube 111 is evacuated, the tube 111 may be sealed by conventional tube sealing methods such as a melt 120 shown in FIG. 12. In addition, gettering agents may be activated to further reduce the pressure in the tube. The cover can prevent these gettering materials from contaminating the particle source.

The method may still further comprise moving the cover 114 for a first time to an open (first) position, so that the electron beam 116 can pass through the aperture 113 to a location near a second end of the tube that is opposite the first end. In one embodiment, moving the cover 114 for the first time may permanently move the cover so that it no longer blocks the path of the electron beam 116 that passes through the apertures 113. The means for displacing the cover may comprise a spring 115 as described above. The spring 115 may be released when a material (not shown), acting as a fuse, is blown by passing an electrical current through it. In an alternative embodiment, the cover may be moved by activating a circuit that moves the cover to expose at least a portion of the aperture.

Alternatively, a cover (not shown) may be solid (no apertures) but may be sufficiently thin that the electron beam 116 may erode or break through that cover. In this instance, the cover could be static (i.e., is not moved to align apertures in the cover and cap).

In yet another embodiment, the method can further comprise moving the cover at least a second time to a closed (second) position. While the cover 114 lies at the closed position, so the cover 114 substantially prevents the electron beam 116 from reaching a location near an opposite end of the tube. In this particular embodiment, the cover 114 is moved to the open position when the gun is activated to generate the electron beam 116 that passes through the apertures 113, and the cover 114 is moved to the closed position when the gun is not activated. This method allows electron source 118 to be protected when not in use. The method may comprise activating an actuator (not shown) that moves the cover between the open and closed positions.

Accordingly, support caps and electron guns can be produced that may substantially prevent or significantly reduce fouling or contamination of electron sources mounted or used therein. Electron sources used in conjunction with such devices may exhibit longer lifetimes as well as better performance than sources used in prior support caps or electron guns. Tubes used accordingly may be manufactured using conventional methods, but can be manufactured without contaminating the electron source during evacuation and sealing processes.

Many other embodiments are possible. In addition to the covers previously described, other attenuators may be used. For example, a miniature electrical precipitator may be used to remove particles (originating from the DAG coating, phosphor, etc.) from the gas during the gas flowing act. Regardless whether the attenuator is a cover or precipitator, the attenuator can block particles from entering aperture(s) in the support cap or support cap assembly. In still another embodiment not illustrated, an attenuator may be activated by a magnetic field used to active the electron gun. The attenuator may rotate as an alternative to linear motion.

As used in this specification, "assembly" refers to an item by itself or in conjunction with other parts. For example, the support cap assembly may only include a support cap, a support cap and another member that holds the electron source, or other potential assemblies. Similarly, an attenuator assembly may include a cover, a cover in combination with other parts, an electrical precipitator and its corresponding operating circuit, or other potential assemblies.

In the foregoing specification, the invention has been described with reference to specific embodiments. However, after reading this specification, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems and any element(s) that may cause any benefit, advantage, or solution to occur or become more pronounced are not to be construed as a critical, required or essential feature or element of any or all the claims.

As used herein, the terms comprises, comprising, "includes," "including," "has," "having" or any other variation thereof, are intended to cover a non-exclusive inclusion. For example, a process, method, article, or apparatus that comprises a list of elements is not necessarily limited only those elements but may include other elements not expressly listed or inherent to such process, method, article, or apparatus. Further, unless expressly stated to the contrary, "or" refers to an inclusive or and not to an exclusive or. In one example, a condition A or B is satisfied by any one of the following: A is true (or present) and B is false (or not present), A is false (or not present) and B is true (or present), and both A and B are true (or present).

What is claimed is:

1. An apparatus comprising:

a cap including an aperture and configured to allow an electron to pass through the aperture; and a cover assembly including a moveable cover adjacent to the aperture, wherein the cover is configured to lie along the electron path during at least one point in time, the cover assembly further including a gear actuator.

2. The apparatus of claim 1, wherein the cover assembly further comprises means for displacing the cover.

3. The apparatus of claim 1, wherein the cover assembly further comprises a spring.

4. The apparatus of claim 3, wherein the spring comprises stainless steel.

5. The apparatus of claim 3, wherein the cover assembly further comprises means for releasing the spring.

6. The apparatus of claim 3, wherein the cover assembly further comprises a material comprising an end, wherein the end is fastened to the spring.

7. The apparatus of claim 6, wherein the material is configured to release the spring when a sufficient amount of an electrical current is passed through the material.

8. The apparatus of claim 1, wherein the cover assembly further comprises a cover guide in contact with the cover.

9. The apparatus of claim 1, wherein the cover comprises stainless steel.

10. The apparatus of claim 1, wherein the cover comprises an insulator.

11. An electron gun comprising:

a cap assembly comprising a cap, a cap aperture, a cover, a spring, and means for releasing the spring, wherein:

the cover overlies the cap aperture during at least one point in time; and the spring comprises a first end attached to the cover and a second end attached to the cap, the spring configured to move the cover in a plane substantially orthogonal to an electron path defined through the cap aperture; and a focus electrode spaced apart and electrically insulated from the cap assembly and comprising a focus aperture in alignment with the cap aperture.

12. The electron gun of claim 11, wherein at least a portion of the cap assembly comprises stainless steel.

13. The electron gun of claim 11, wherein the cover comprises stainless steel.

14. The electron gun of claim 11, wherein the cover comprises an insulator.

15. The electron gun of claim 11, wherein the cap further comprises a cover guide in contact with the cover.

* * * * *